US005107867A

United States Patent [19]

Barrington

[11] Patent Number: 5,107,867

[45] Date of Patent: Apr. 28, 1992

[54] PROCESS FOR EXTENDING HUMAN HAIR

[76] Inventor: Mark C. Barrington, 8432 Aplite Ct., Citrus Heights, Calif. 95610

[21] Appl. No.: 753,211

[22] Filed: Aug. 29, 1991

[51] Int. Cl.[5] ..... A41G 3/00

[52] U.S. Cl. ..... 132/201; 132/53

[58] Field of Search ..... 132/200, 201, 53, 54, 132/56

[56] References Cited

U.S. PATENT DOCUMENTS

| | | | |
|---|---|---|---|
| 2,621,663 | 12/1952 | Jenkins | 132/201 |
| 2,865,380 | 12/1958 | Mitchell | 132/201 |
| 3,295,534 | 1/1967 | Dorkin | 132/201 |
| 3,530,862 | 9/1970 | Hudson | 132/201 |
| 3,835,868 | 9/1974 | Heck | 132/201 |
| 3,970,092 | 7/1976 | Nelson | 132/201 |
| 4,372,330 | 2/1983 | Nelson | 132/53 |
| 4,934,387 | 6/1990 | Megna | 132/201 |
| 4,982,748 | 1/1991 | Trimarchi | 132/201 |

FOREIGN PATENT DOCUMENTS

| | | | |
|---|---|---|---|
| 3722108 | 1/1989 | Fed. Rep. of Germany | 132/201 |

*Primary Examiner*—John J. Wilson
*Assistant Examiner*—Frank A. LaViola
*Attorney, Agent, or Firm*—John P. O'Banion

[57] ABSTRACT

A reversible process for attaching permanent extensions to human hair in which strands of supplemental hair are joined with a thermostable adhesive to form a plug of supplemental hair, a coating of thermosetting adhesive is applied over the thermostable adhesive and cured, strands of the person's natural hair are threaded through a section of heat shrinkable tubing, the plug of supplemental hair is inserted into the heat shrinkable tubing, and heat is applied to the heat shrinkable tubing so that the thermosetting adhesive liquifies and joins the plug of supplemental hair and natural hair, and the heat shrinkable tubing shrinks in size to compress and seal the junction. The permanent extension can be removed by reapplication of heat to the heat shrinkable tubing.

18 Claims, 2 Drawing Sheets

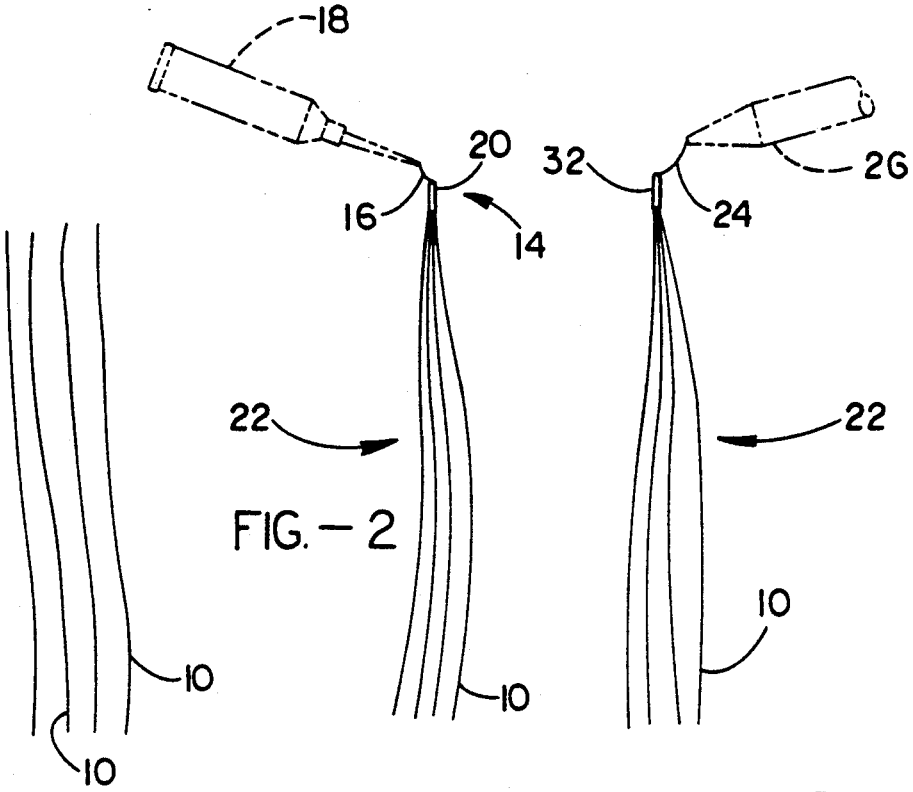
FIG. – 1
FIG. – 2
FIG. – 3
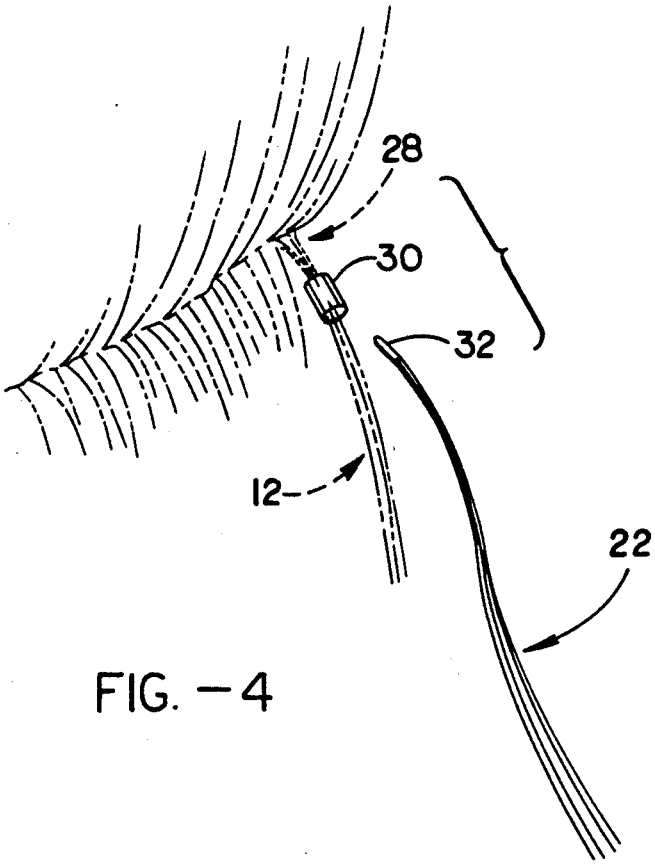
FIG. – 4

PROCESS FOR EXTENDING HUMAN HAIR

BACKGROUND OF THE INVENTION

1. Field of the Invention

This invention relates generally to hair extension techniques, and more particularly to a process for extending human hair which uses adhesives and heat shrinkable tubing to produce a hair extension which is durable, permanent, and generally impervious to the elements.

2. Description of the Background Art

While many persons suffer from loss or thinning of their hair and, therefore, seek more traditional solutions such as implants and hairpieces, others simply desire to change their appearance through longer or shorter hair styles. For many, changing a hair style is as commonplace as changing attire from day to day. Quite often, a hair style will require a shorter or longer cut than the person currently possesses.

It is well known that an easy solution to achieve a shorter hair style is to cut the hair. Once cut, however, it is far more difficult to lengthen the hair. Therefore, hair extensions have become a popular way for persons with short hair to change to a longer hair style. Many persons often seek an extension which lasts only for a few days. Others might desire a more permanent extension which lasts for several weeks or months.

Several approaches to hair extensions have been previously developed. For example, U.S. Pat. No. 4,982,748 issued to Trimarchi on Jan. 8, 1991, discloses a method of semi-permanent attachment of filaments of synthetic hair to sections of natural hair through the ordered sectioning of the natural hair and the intertwining or braiding of the natural and synthetic hair followed by wrapping the braided portion of natural and synthetic hair with a portion of synthetic hair, applying a sealer, and then applying heat to the wrapped layer of synthetic hair. The heat causes the sealer to change from a liquid to a semi-solid, and is applied only to the wrapped layer of synthetic hair and not to the natural hair thereby preventing damage to the natural hair. U.S. Pat. No. 4,934,387 issued to Megna on June 19, 1990, discloses a method for lengthening hair wherein strands of supplemental hair are aligned with strands of the natural hair, a colored thermoplastic adhesive is applied to the junction of the supplemental hair and natural hair with a glue gun, the glue is permitted to partially cool at which time the glued junction is rolled between the fingers to intertwine the strands of hair, and the combined hair is then styled. U.S. Pat. No. 4,372,330 issued to Nelson on Feb. 8, 1983, discloses a method for attaching hair wherein a pair of filaments are intertwined with tufts of the user's natural hair into a braid. Glue is used to seal the weave in place. U.S. Pat. No. 3,835,868 issued to Heck on Sept. 17, 1974, discloses a method for making hairpieces on a form which includes pulling the strands of hair away from the form, applying a resin to the base of the strands, and curing the resin so that the strands emerge from the form at an abrupt angle as opposed to laying flat. U.S. Pat. No. 2,621,663 issued to Jenkins on Dec. 16, 1952, discloses a weaving method for permanently attaching supplemental hair to natural hair. U.S. Pat. No. 2,865,380 issued to Mitchell on Dec. 23, 1958, discloses a weave method for attaching a hairpiece of multiple tufts connected to a flexible rod to natural hair, the natural hair being plaited to facilitate attachment. U.S. Pat. No. 3,530,862 issued to Hudson on Sept. 29, 1970, discloses aligning multiple strands of hair to rods and then using an elastic band to hold the rods and multiple stranqs of hair together to form a hairpiece. U.S. Pat. No. 3,295,534 issued to Dorkin on Jan. 3, 1967, discloses a method of thickening hair by permanently attaching additional strands of hair to natural hair with an adhesive.

In order for a hair extension which uses adhesives to be "permanent" so that it will last several weeks or months and not shed or mat, the adhesive junction of the supplemental hair and the person's natural hair must be resistent to foreign elements such as chlorine, permanent wave solutions, coloring solutions, bacteria, oils, shampoos, hair sprays, heat, and the like. Such a solution does not exist in the hair extension techniques previously developed. Therefore, there is a need for an easily implemented, improved process for attaching strands of supplemental hair to a person's natural hair in which the junction between the supplemental hair and the natural hair is generally impervious to these types of foreign elements.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

The process of the present invention fabricates hair extension "plugs" from bundles of strands of natural or synthetic supplemental hair. The strands are joined together at one end of the bundle with a thermostable adhesive such as cyanoacrylate to form a plug of supplemental hair, one end of which will have a hardened tip while the other end will have free-flowing strands of supplemental hair. Once the thermostable adhesive cures to a hardened state, the tip of the plug is coated with a thermosetting adhesive such as a hot melt glue. After the thermosetting adhesive cools to a hardened state, the plug of supplemental hair is ready to attach to the person's natural hair. Strands of the person's natural hair are then threaded through a section of heat shrinkable tubing, and the thermosetting adhesive coated tip of the plug of supplemental hair is inserted into the heat shrinkable tubing. Heat is then applied to the heat shrinkable tubing with, for example, a hair flat iron until the thermosetting adhesive liquifies and joins the tip of the plug of supplemental hair with the person's natural hair, and the heat shrinkable tubing shrinks in size to compress and seal the junction. The permanent extension can be removed by reapplication of heat with the hair flat iron.

An object of the invention is to provide a method for easily applying hair extensions.

Another object of the invention is to provide a method for attaching permanent hair extensions.

Another object of the invention is to provide a method of extending the length of human hair in which the junction between the natural hair and supplemental hair is highly resistent to bacteria, chlorine, permanent wave solutions, hair coloring solutions, and the like.

Another object of the invention is to provide a method for permanent hair extension which can be easily reversed when desired.

Another object of the invention is to provide for hair extensions in which the strands of hair do not shed.

Still another object of the invention is to provide for hair extensions in which the strands of hair do not mat together.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only:

FIG. 1 is a view of a bundle of strands of supplemental hair prior to formation into a hair extension plug.

FIG. 2 shows the application of a thermostable adhesive to the strands of supplemental hair at one end of the bundle shown in FIG. 1 to form a plug of supplemental hair.

FIG. 3 shows the application of a thermosetting adhesive to the tip of the plug of supplemental hair shown in FIG. 2.

FIG. 4 is a partial perspective view of the back of the head of a person showing the insertion of strands of natural hair through a length of heat shrinkable tubing just prior to insertion of the plug of supplement hair shown in FIG. 3.

DESCRIPTION OF THE PREFERRED EMBODIMENTS

Figure 5:
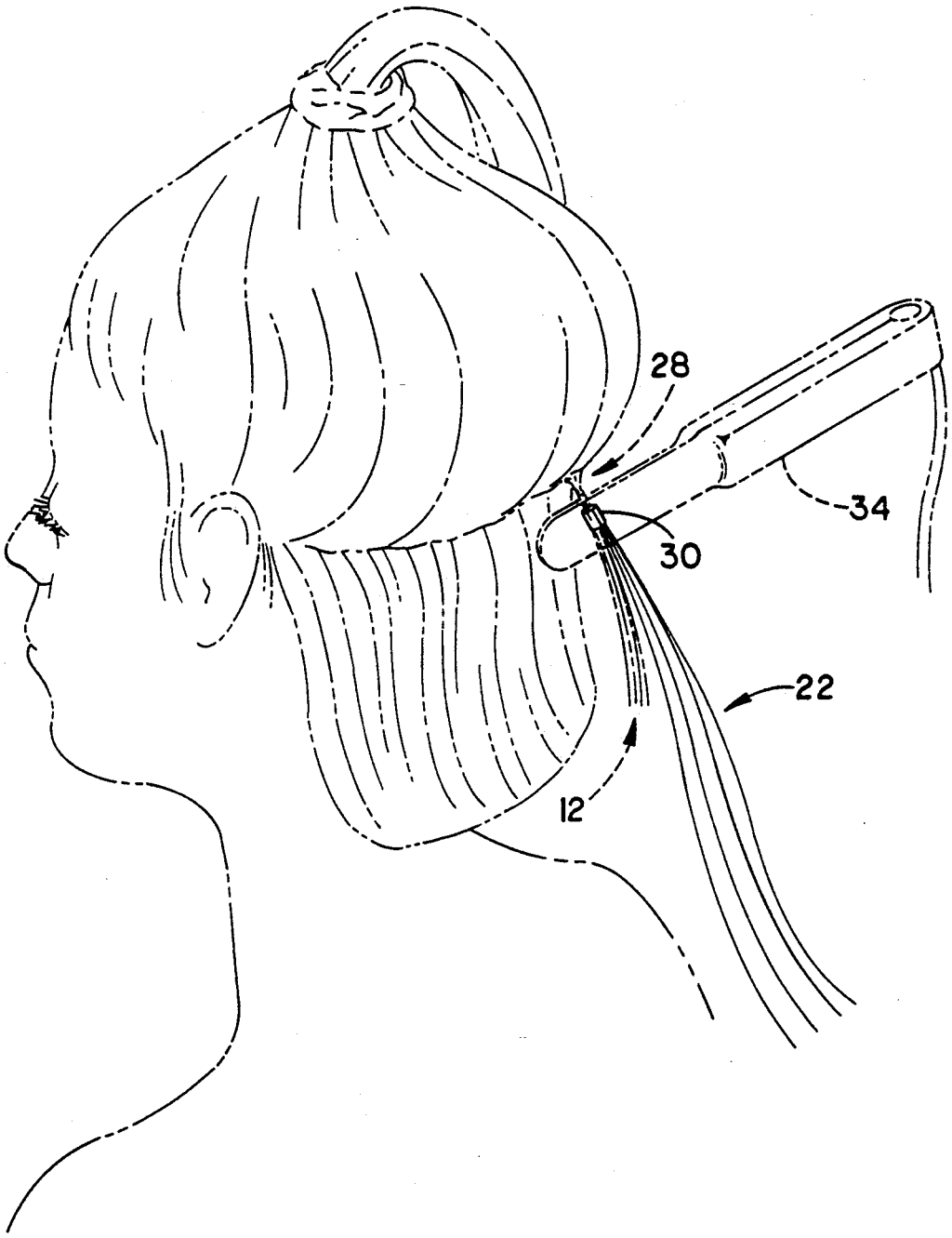
FIG. 5 is a perspective view of the back of the head of the person shown in FIG. 4 which shows the application of heat to the heat shrinkable tubing after insertion of the plug of supplemental hair shown in FIG. 3.

Referring more specifically to the drawings, for illustrative purposes the process of the present invention is embodied in the steps generally shown in FIGS. 1 through 5. It will be appreciated that the process may vary as to configuration and as to details of the steps and materials employed without departing from the basic concepts as disclosed herein.

Referring to FIG. 1, a plurality of strands of supplemental hair 10 are bundled together as shown. Typically, this calls for approximately twenty-five to fifty strands of supplemental hair 10 to be aligned in a generally parallel configuration. Although strands of supplemental hair 10 could be made of synthetic materials, strands of human hair are preferred for a more natural appearance. Preparation and cleansing of strands of supplemental hair 10, as well as the person's natural hair 12 (FIG. 4), is an important step in that it promotes proper adhesion of the thermostable and thermosetting adhesives used in this process. Preferably a celating shampoo such as Remove-All made by Tressa is used to cleanse the supplemental and natural hair and remove dirt, chlorine, hair spray, oils, residues, gels, wax, and the like so as to provide a good bonding surface. Any hair which is cleansed should be thoroughly dried before proceeding.

Referring to FIG. 2, after strands of supplemental hair 10 are cleansed and dried, they are gathered together at end 14 and a thermostable adhesive 16 is applied from applicator 18, thereby coating and impregnating strands of supplemental hair 10 at end 14. Thermostable adhesive 16 is preferably a heat resistent, air drying adhesive such as cyanoacrylate. Thermostable adhesive 16 cures and hardens into tip 20, thereby forming supplemental hair plug 22.

Referring to FIG. 3, after thermostable adhesive 16 hardens, it is coated with thermosetting adhesive 24 which is applied from applicator 26. Thermosetting adhesive 24 can be any thermosetting natural or synthetic polymer adhesive, such as Thermogrip ® brand hobby type hot melt glue which is water repellent. The thermosetting adhesive 24 is then allowed to cool and harden.

Referring to FIG. 4, the next step is to divide or otherwise orderly section the person's natural hair into one or more application zones 28. Each application zone 28 should preferably be spaced approximately one-quarter inch (6.4 millimeters) apart both horizontally and vertically for proper blending of the supplemental hair with the natural hair. Prior to application of plug 22, the natural hair is parted across the back of the head and combed over the top of the head to the extent possible as shown in FIG. 5. As a result, each supplemental hair plug 22 will cover the area bounded by a square which is one-quarter inch (6.4 millimeters) on each side Approximately twenty-five to fifty strands of natural hair 12 are then threaded through a length of heat shrinkable tubing 30 which is approximately one-quarter inch (6.4 millimeters) long, and heat shrinkable tubing 30 is positioned approximately three-eights of an inch (9.5 millimeters) away from the scalp. Heat shrinkable tubing 30 preferably has a diameter of approximately three-thirty seconds of an inch (2.4 millimeters) and reduces in size by approximately fifty percent upon application of heat. Any standard grade heat shrinkable tubing such as that make by Icorally for electronic purposes is suitable. Thermosetting adhesive coated tip 32 of supplemental hair plug 22 is then inserted approximately half way into heat shrinkable tubing 30.

Referring now to FIG. 5, a hair flat iron 34 or other heat source is used to apply heat to heat shrinkable tubing 30 for approximately five seconds or until thermosetting adhesive 24 liquifies. When thermosetting adhesive 24 liquifies, it flows over the strands of natural hair 12 to bind natural hair 12 to tip 20 of supplement hair plug 22. Heat shrink tubing 30 shrinks to compress the junction of natural hair 12 and tip 20 of supplemental hair plug 22. Note that thermostable adhesive 16 which surrounds strands of supplemental hair 10 to form tip 20 does not liquify at this point and, therefore, heat shrink tubing 30 does not flatten but retains a cylindrical shape when it shrinks. Thermosetting adhesive 24, however, liquifies and flows inside heat shrinkable tubing 30 to saturate and seal the junction of supplemental hair plug 22 and natural hair 12. Thermosetting adhesive 24 is then allowed to cool and harden, and the persons natural hair (or other supplemental hair) is combed down to hide the heat shrinkable tubing 30. In this manner, a natural looking hair extension results.

Removal of supplemental hair plug 22 can be effected by re-heating heat shrinkable tubing 30, pulling out supplemental hair plug 22, and sliding heat shrinkable tubing 30 off of natural hair 12. Traces of thermosetting adhesive 24 which remain in natural hair 12 can be removed by conventional non-damaging techniques if necessary.

Accordingly, it will be seen that this invention presents a reversible process for permanently joining natural hair to supplemental hair in a way that the adhesive junction of the supplemental and natural hair is generally impervious to bacteria, heat, hair conditioners, permanent wave solutions, hair coloring solutions, dirt, and the like. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A process for attaching supplemental hair to human natural hair, comprising the steps of:

(a) coating one end of a plug of supplemental hair with thermosetting adhesive;

(b) allowing said thermosetting adhesive to harden;

(c) threading a plurality of strands of natural hair through a length of heat shrinkable tubing;

(d) inserting the thermosetting adhesive coated end of said plug of supplemental hair into said heat shrinkable tubing;

(e) applying heat to said heat shrinkable tubing and said thermosetting adhesive; and (f) allowing said thermosetting adhesive to harden.

2. The process recited in claim 1, further comprising the step of cleansing said natural hair with a celating shampoo prior to the step of threading said plurality of strands of natural hair through said heat shrink tubing.

3. The process recited in claim 1, further comprising the step of drying said cleansed natural hair.

4. The process recited in claim 1, further comprising the step of dividing said natural hair into a plurality of application zones prior to the step of threading said plurality of strands of natural hair through said heat shrink tubing.

5. The process recited in claim 1, wherein each said plug of supplemental hair contains from 25 to 50 strands.

6. The process recited in claim 1, further comprising the step of covering the junction of said plug of supplemental hair and said natural hair with natural or supplemental hair.

7. A process for extending the length of a person's natural hair with supplemental hair, comprising the steps of:

(a) bundling a plurality of strands of supplemental hair, said bundle of strands of supplemental hair having a first end and a second end;

(b) impregnating said first end of bundle of strands of supplemental hair with thermostable adhesive;

(c) forming a plug of supplemental hair by allowing said thermostable adhesive to harden and bind said first end of said bundle of strands of supplemental hair;

(d) coating said hardened thermostable adhesive with thermosetting adhesive;

(e) allowing said thermosetting adhesive to harden;

(f) threading a plurality of strands of natural hair through a length of heat shrinkable tubing;

(g) inserting the thermosetting adhesive coated end of said plug into said heat shrinkable tubing;

(h) applying heat to said heat shrinkable tubing and said thermosetting adhesive; and (i) allowing said thermosetting adhesive to harden.

8. The process recited in claim 7, further comprising the step of cleansing said natural hair with a celating shampoo prior to the step of threading said plurality of strands of natural hair through said heat shrink tubing.

9. The process recited in claim 7, further comprising the step of drying said cleansed natural hair.

10. The process recited in claim 7, further comprising the step of dividing said natural hair into a plurality of application zones prior to the step of threading said plurality of strands of natural hair through said heat shrink tubing.

11. The process recited in claim 7, wherein each said plug of supplemental hair contains from 25 to 50 strands.

12. The process recited in claim 7, further comprising the step of covering the junction of said plug and said natural hair with natural or supplemental hair.

13. A hair extension process, comprising the steps of:

(a) coating one end of each of a plurality of strands of supplemental hair with thermostable adhesive;

(b) joining said coated ends of said plurality of strands of supplemental hair to form a plug of supplemental hair;

(c) allowing said thermostable adhesive to harden;

(d) coating said hardened thermostable adhesive with thermosetting adhesive;

(e) allowing said thermosetting adhesive to harden;

(f) threading a plurality of strands of natural hair through a length of heat shrinkable tubing;

(g) inserting the thermosetting adhesive coated end of said plug into said heat shrinkable tubing;

(h) applying heat to said heat shrinkable tubing and said thermosetting adhesive; and (i) allowing said thermosettng adhesive to harden.

14. The process recited in claim 13, further comprising the step of cleansing said natural hair with a celating shampoo prior to the step of threading said plurality of strands of natural hair through said heat shrink tubing.

15. The process recited in claim 13, further comprising the step of drying said cleansed natural hair.

16. The process recited in claim 13, further comprising the step of dividing said natural hair into a plurality of application zones prior to the step of threading said plurality of strands of natural hair through said heat shrink tubing.

17. The process recited in claim 13, wherein each said plug of supplemental hair contains from 25 to 50 strands.

18. The process recited in claim 13, further comprising the step of covering the junction of said plug and said natural hair with natural or supplemental hair.

* * * * *